US006517374B2

(12) United States Patent
Maeda

(10) Patent No.: US 6,517,374 B2
(45) Date of Patent: Feb. 11, 2003

(54) INSULATION DISPLACEMENT AND PRESS CONNECTOR DEVICE

(75) Inventor: Akira Maeda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/730,553

(22) Filed: Dec. 7, 2000

(65) Prior Publication Data

US 2001/0004565 A1 Jun. 21, 2001

(30) Foreign Application Priority Data

Dec. 15, 1999 (JP) ..... 11-356620

(51) Int. Cl.[7] ..... H01R 4/24; H01R 4/26; H01R 11/20

(52) U.S. Cl. ..... 439/417; 439/400

(58) Field of Search ..... 439/404, 389, 439/395, 400, 405, 417

(56) References Cited

U.S. PATENT DOCUMENTS 5,820,404 A * 10/1998 Chishima et al. ..... 439/417
6,135,827 A * 10/2000 Okabe et al. ..... 439/731

FOREIGN PATENT DOCUMENTS

JP 2000-150055 5/2000

* cited by examiner

*Primary Examiner*—Khiem Nguyen
*Assistant Examiner*—Chandrika Prasad
(74) *Attorney, Agent, or Firm*—Finnegan, Henderson, Farabow, Garrett, & Dunner, L.L.P.

(57) ABSTRACT

A terminal is for displacing an insulator of an insulated wire. A housing includes an end which defines a groove for accommodation of the terminal. The end defines an insertion part for insertion of a jig for pressing the insulated wire to the terminal.

4 Claims, 4 Drawing Sheets

INSULATION DISPLACEMENT AND PRESS CONNECTOR DEVICE

BACKGROUND OF THE INVENTION

The present invention relates to an insulation displacement connector in which the insulation displacing terminal is accommodated and disposed, the terminal for an end of a wire to be pressed and fitted for connection.

Conventionally, this kind of an insulation displacement connector includes respective insulation displacing terminals which are accommodated in respective terminal accommodating grooves formed for arrangement in a row in a housing. In the terminals, insulation wires are pressed and fitted for connection by a pressing jig.

SUMMARY OF THE INVENTION

An end of the housing of the above-described connector, however, has a thickness dimension in a transverse direction different from that of a partition between the adjacent grooves. Specially, the thickness dimension of the end of the housing can not be shortened as well as the partition between the adjacent grooves, in relation to strength or mounting structure of the housing. Thus, in order to press and fit insulation wires in the terminal accommodated in the groove positioned at the end of the housing in a transverse direction, the pressing jig can not be used, and another jig with a guide member formed of a different structure is necessary. Therefore, a plurality of pressing jigs are employed for the identical housing, and an assembly operation of the insulated wire is complicated, so that a mounting operation can not be smoothly performed.

An object of the present inventions to provide an insulation displacement connector which makes a wire mounting operation smoothly performed by one kind of pressing jig.

To achieve the object, a first aspect of the invention provides an insulation displacement connector as the following. A terminal is for displacing an insulator of an insulated wire. A housing includes an end which defines a groove for accommodation of the terminal. The end defines an insertion part for insertion of a jig for pressing the insulated wire to the terminal.

Preferably, the terminal includes a side plate; and a blade extending inward from the side plate to cut out the insulator.

Preferably, the housing includes a partition defining the groove with the end. The partition has a thickness substantially identical to the end.

Preferably, the insertion part is recessed.

A second aspect of the invention provides an assembly structure of an insulation displacement connector as the following. A terminal is for displacing an insulator of the insulated wire. A housing includes an end which defines a groove accommodating the terminal and defines an insertion part. A jig includes a pressing member pressing the insulated wire to the terminal; and a guide member for guide of the pressing member inserted in the insertion part.

According to the aspects, when pressing and fitting the insulated wire to the terminal accommodated in the groove positioned at an end of the housing, by inserting the guide member in the insertion part, the wire is pressed for fitting as an insulated wire is pressed for fitting in an insulation displacing terminal accommodated in a groove positioned at an intermediate part in a transverse direction of the housing.

Thus, by using the identical jig, respective insulated wires can be pressed for fitting in and connected to respective insulation displacing terminals accommodated in grooves of the housing. As a result, the jig employed for pressing the insulated wire for fitting is one kind, and an operation for pressing and fitting the wire is remarkably facilitated. The insertion part is opened at the housing, and the connector lightens.

The insulated wire is pressed to the blade provided to the side plate to cut out the insulator, and the wire and the terminal are electrically connected each other.

When pressing the insulated wire for fitting, though a pair of side plates are subjected to a pressing and widening action, the guide member holds partitions which a groove for accommodation of the terminal is interposed between or a partition and the end of the insertion part, and the side plates is prevented from being pressed and widened.

The guide member is inserted in the insertion part under a condition as identical as inserted in another groove, and pressing and fitting operation of the insulated wire is facilitated.

BRIEF DESCRIPTION OF THE ACCOMPANYING DRAWINGS

DETAILED DESCRIPTION OF THE PREFERRED EMBODIMENT

Figure 1:
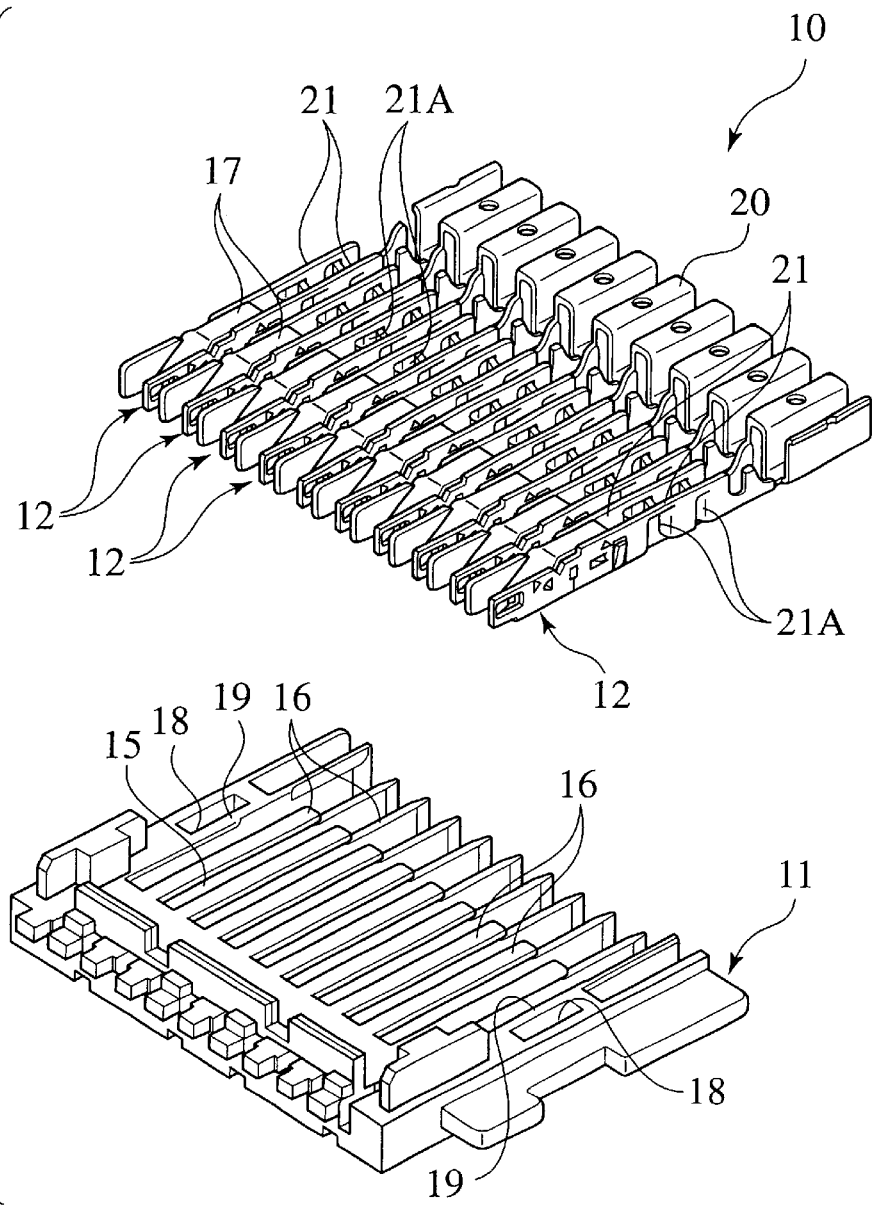
FIG. 1 is an exploded perspective view of an assembly step showing an embodiment of an insulation displacement connector according to the present invention.

Details of an insulation displacement connector according to the present invention will be described below based on an embodiment shown in the drawings.

A structure of a connector housing 11 will be first described by using FIG. 1. In the housing 11, terminal accommodating grooves 15 for accommodating respective insulation displacing terminals 12 are formed in parallel and respective adjacent grooves 15 are separated from each other by partitions 16. In a bottom part of each the groove 15, an opening part for connection (not shown) for enabling a tab 17 for connection that will be described later to be inserted into a part to be connected of the terminal 12 is formed. In upper faces of opposite side parts in a transverse direction of the housing 11, jig insertion recessed parts 18 are formed respectively. Side walls 19 for respectively separating the recessed parts 18 and the grooves 15 adjacent to the recessed parts 18 have the identical thickness as the partitions 16 for separating the respective adjacent grooves 15.

Next, a structure of the terminal 12 will be described. As shown in FIG. 1, a multiple continuous body of a plurality of terminals 12 is employed in the present embodiment. In other words, as shown in FIG. 1, longitudinal one side end parts of the plurality of terminals 12 are formed integrally with the other side edge of a carrier 20 at predetermined intervals.

Side plates 21 on opposite sides in a transverse direction of the terminal 12 are bent to face each other and the terminal 12 has a tab 17 bent to be folded back diagonally upward from a lower part of longitudinal the other side end of the terminal 12 and extending toward the one side end side of the terminal 12. The part to be connected (not shown) is formed under the tab 17. A tab 17 of another terminal 12 disposed and placed under the terminal 12 can be inserted into and connected to the part to be connected. The side plates 21 facing each other are formed with a pair of or a plurality of pairs of insulation displacing blades 21A extending inward between the side plates 21 and for cutting out resin insulation 13B with which a periphery of a core 13A of an insulated wire 13 is covered.

The multiple continuous body of the terminals 12 shown in FIG. 1 is in a state in which the continuous body has been subjected to a press step such that spaces between respective adjacent terminals 12 are reduced to be predetermined lengths. In other words, as shown in FIG. 1, presswork is applied to fold the carrier 20 such that the gaps are reduced and that the continuous body can be accommodated in the connector housing 11.

Figure 2:
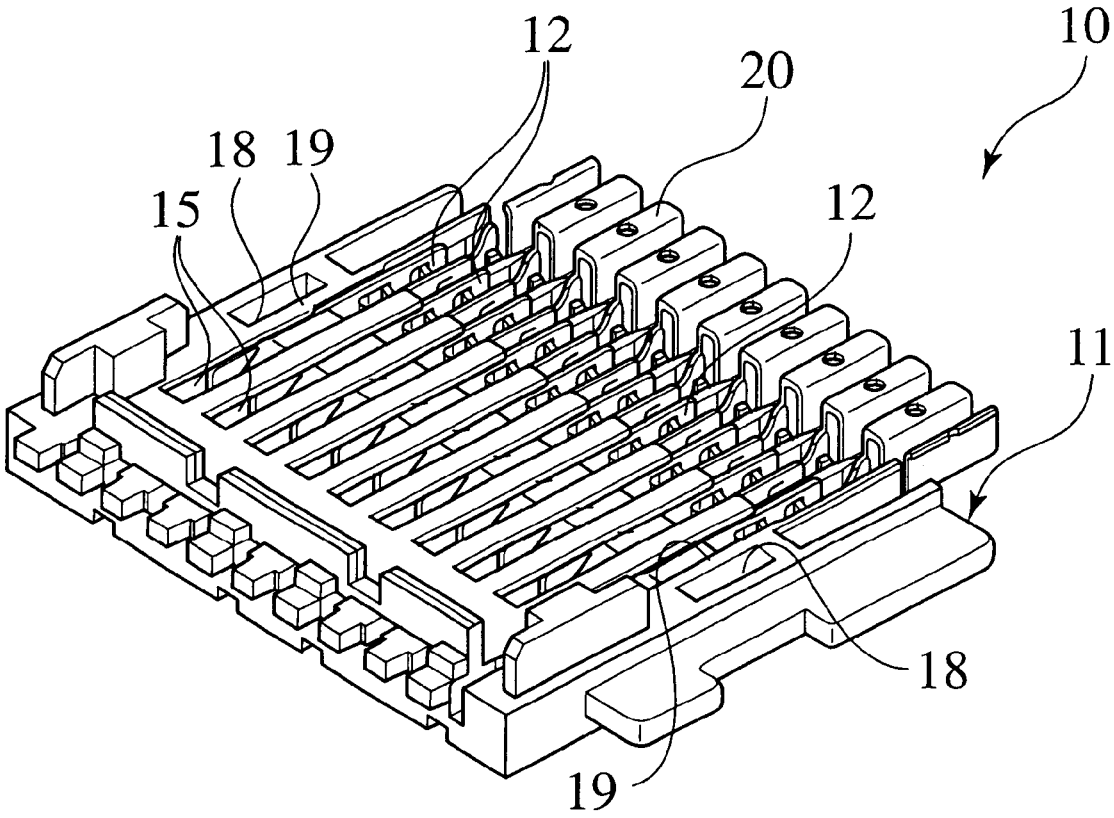
FIG. 2 is a perspective view of the insulation displacement connector of the embodiment.

Then, as shown in FIG. 2, the multiple continuous body of the terminals 12 is provisionally accommodated in the housing 11 (an assembly step). In this step, only the carrier 20 of the multiple continuous body of the terminals 12 is not accommodated in the housing 11.

In this state, the carrier 20 is then cut in a predetermined position according to a design of an electric circuit. The tabs 17 of predetermined terminals 12 are raised. At this time, only predetermined tabs 17 of the tabs 17 are raised so as to form a predetermined electric circuit by a relationship between a connector 10 that is formed of the terminals 12 accommodated in the housing 11 and another connector placed on or under the connector 10.

In order to cut the carrier 20, jigs (not shown) are placed such that a part of the carrier 20 in a predetermined position is interposed between the jigs and a cutting jig (not shown) is moved down from above. As a result, the carriers 20 are electrically separated from each other when a cut piece of the carrier 20 is removed.

Figure 3:
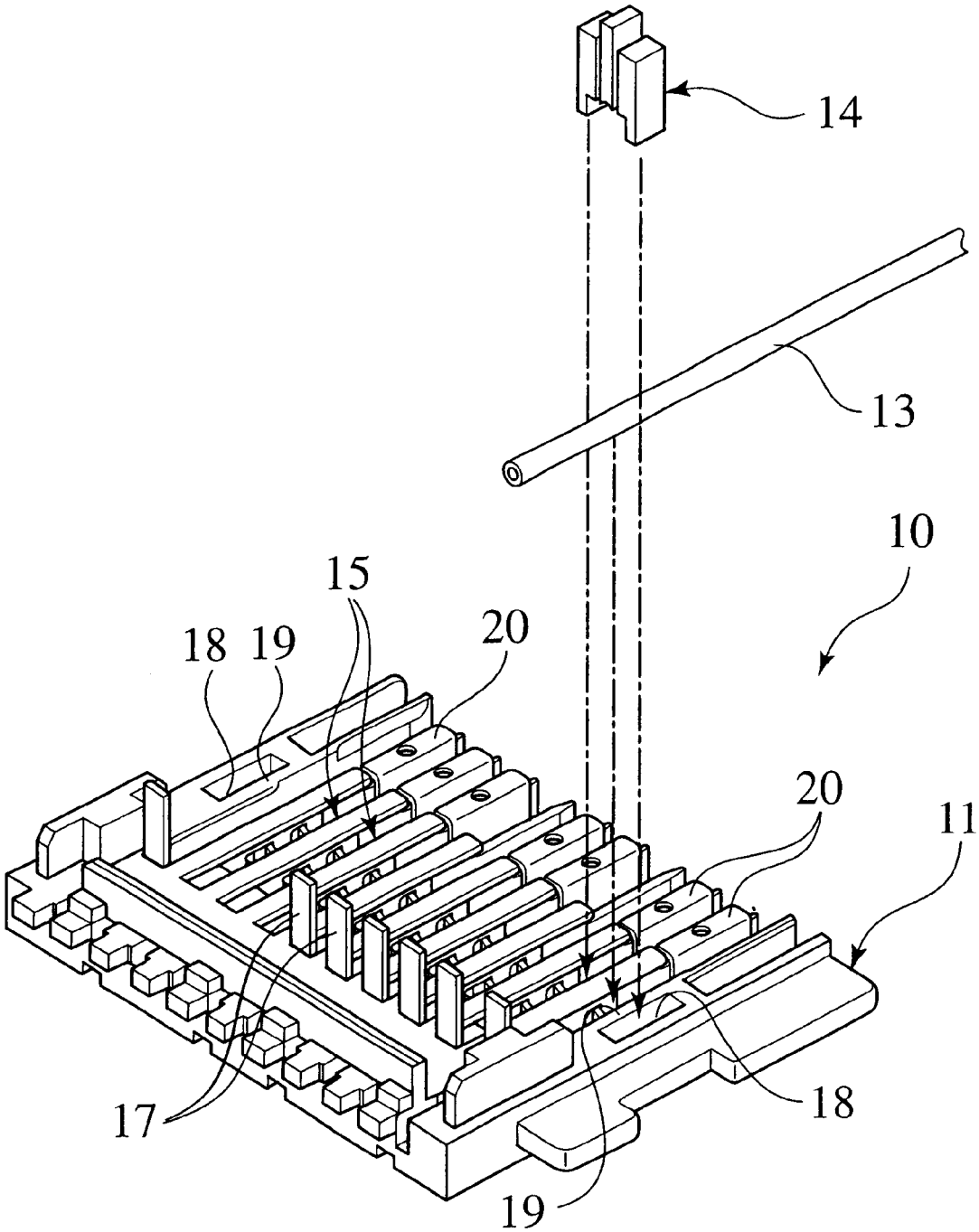
FIG. 3 is a perspective view showing a step of mounting insulated wires to the insulation displacement connector of the embodiment.

Then, as shown in FIG. 3, the entire terminals 12 including the carrier 20 are accommodated in the housing 11. At this time, the carrier 20 that has not been cut is accommodated to cross over the partitions 16 of the housing 11. Then, as shown in FIG. 3, wires 13 are respectively pressingly fitted in and mounted to the respective terminals 12.

Figure 4:
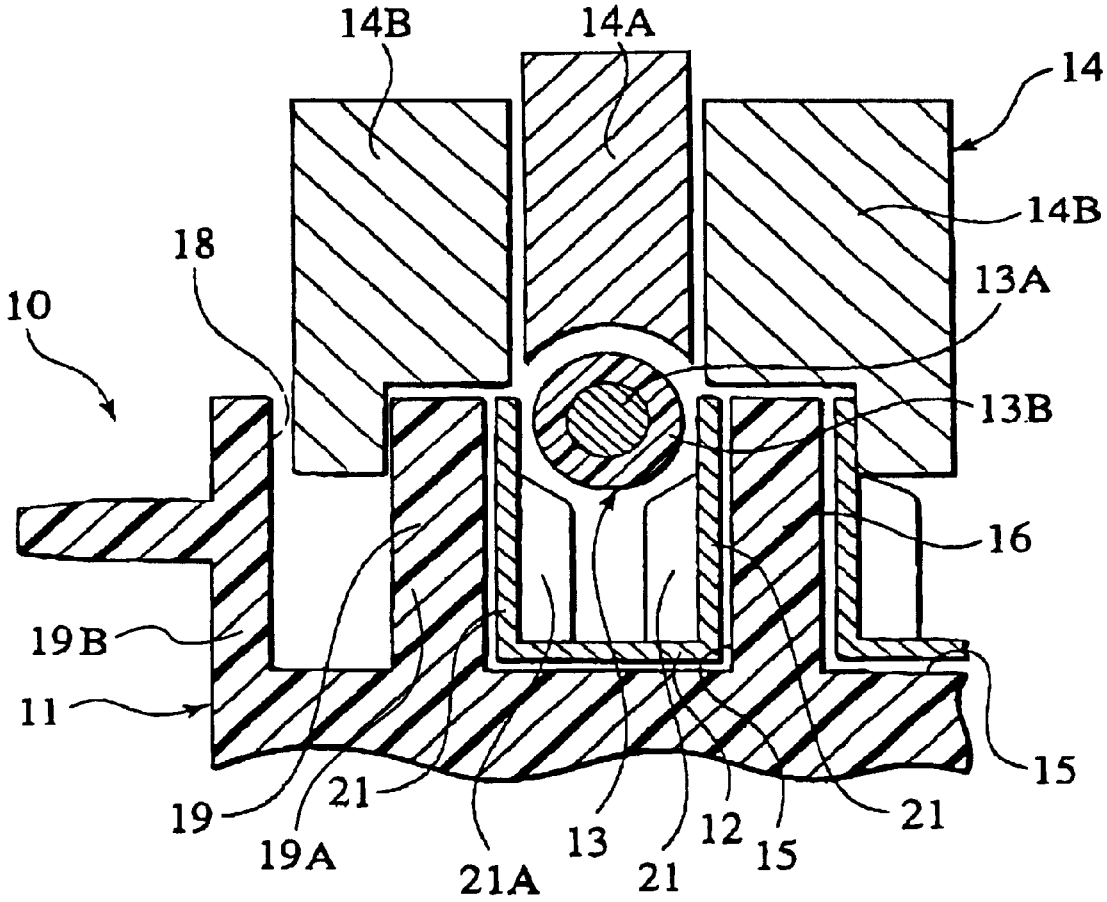
FIG. 4 is a sectional view showing a step of mounting the insulated wires to the insulation displacement connector of the embodiment.

Next, a method of pressingly fitting the wire 13 into the terminal 12 will be described in accordance with FIGS. 3 and 4. A jig 14 is formed of a press-fitting member 14A and guide members 14B formed on opposite sides of the press-fitting member 14A. Lower end parts of the guide members 14B have such shapes as to be bought in contact with upper faces and side faces of the partitions 16 on opposite sides of the groove 15 in which the predetermined terminal 12 is accommodated or of the partitions 16 and the side walls 19 as shown in FIG. 4. The press-fitting member 14A can get out and in the guide members 14B on the opposite sides. A lower end part of the guide member 14B is formed such that a distal end of the guide member 14B positioned on one end part side in a transverse direction of the connector housing 11 is inserted in the insertion recessed part 18 as shown in FIG. 4. As described above, the side walls 19 for respectively separating the insertion recessed parts 18 and the grooves 15 adjacent to the recessed parts 18 have the identical thickness as the partitions 16 for separating the respective adjacent grooves 15. Therefore, the distal end of the guide member 14B can be inserted in the insertion recessed part 18 on the one end part side in the transverse direction of the housing 11 on the identical condition as the distal end is inserted into the groove 15.

By using such a jig 14, the wires 13 can be successively pressingly fitted in the terminals 12 accommodated in the respective grooves 15. Because the insertion recessed parts 18 are formed on opposite side parts of the housing 11, the wires 13 can be pressingly fitted into and connected to the terminals 12 accommodated in all the grooves 15 by using the jig 14.

Thus, the terminals 12 are accommodated in the housing 11 and the connector 10 in which the wires 13 are connected to the terminals 12 is completed. Then, by stacking the connectors 10 vertically with the predetermined tabs 17 raised, the raised tab 17 of the lower connector 10 is inserted in an opening part for connection (not shown) formed on a lower face of the upper connector 10 and is connected to the part to be connected of each the terminal 12.

Although the embodiment has been described above, the present invention is not limited to the embodiment and various modifications accompanying summary of the structure may be made. For example, although the terminal 12 having the raised tab 17 is employed in the above embodiment, it is of course possible to apply the invention to an insulation displacement connector for which insulation displacing terminals with other structures are employed.

What is claimed is:

1. A system for displacing an insulator from a wire and press connecting the wire, the system comprising:

a terminal including a first side plate and second side plate facing the first side plate, the first and second side plates being configured to displace the insulator from the wire to allow the wire and said terminal to electrically connect;

a connector housing including a first groove configured to receive the terminal, and an engagement hole positioned at an end portion of said connector housing and spaced from the first groove by a wall and a second groove spaced from the first grove by a partition; and a press connecting device including a pair of guide members and a pressing member positioned between the pair of guide members to move relative to the guide members, the pressing member being configured to press the wire between the first and second side plates of the terminal, where one guide member is positioned proximate the wall for insertion in the engagement hole, the other guide member is positioned proximate the partition for insertion in the second groove, and the pressing member is positioned proximate the terminal residing in the first groove for insertion in the first groove.

2. The system of claim 1, wherein the pressing member descends into the terminal.

3. The system of claim 2, wherein the pressing member descends downward into the first groove beyond the guide members.

4. The system of claim 3, wherein the passing member is guided between the guide members to press the wire between the first and second slide plates.

* * * * *